United States Patent [19]

Grass

[11] Patent Number: 4,834,555

[45] Date of Patent: May 30, 1989

[54] FIXTURE FOR THE ATTACHMENT OF A GUIDE RAIL TO THE BODY OF A PIECE OF FURNITURE

[75] Inventor: Alfred Grass, Höchst, Austria

[73] Assignee: Alfred Grass Ges.m.b.H. Metallwarenfabrik, Hochst/Vlbg, Austria

[21] Appl. No.: 853,026

[22] Filed: Apr. 17, 1986

[30] Foreign Application Priority Data

May 10, 1985 [DE] Fed. Rep. of Germany ..... 3517001

[51] Int. Cl.[4] ..... A47B 88/04

[52] U.S. Cl. ..... 384/19; 248/220.2; 248/243; 312/350; 384/22

[58] Field of Search ..... 384/7, 18–23; 312/350, 338, 345; 248/243, 220.2, 222.2

[56] References Cited

U.S. PATENT DOCUMENTS

| | | | |
|---|---|---|---|
| 2,713,985 | 7/1955 | Kleekner et al. | 248/243 |
| 3,677,615 | 7/1972 | Hudson | 312/350 X |
| 3,712,698 | 1/1973 | Propst et al. | 312/350 |
| 3,716,628 | 2/1973 | Vogt | 312/350 X |
| 4,147,393 | 4/1979 | Nelson et al. | 384/22 |
| 4,193,649 | 3/1980 | Sharon | 248/243 X |
| 4,566,743 | 1/1986 | Henriott | 384/20 X |
| 4,681,289 | 7/1987 | Gronlund et al. | 248/243 X |

FOREIGN PATENT DOCUMENTS

| | | | |
|---|---|---|---|
| 3141158 | 5/1983 | Fed. Rep. of Germany | 312/350 |

*Primary Examiner*—Thomas R. Hannon

[57] ABSTRACT

The attachment of a guide rail on the side wall of a body in which an attachment clip is used which engages with its spring legs in a perforated strip on the inner face of the wall of the body. The guide rail is inserted into a mounting on the attachment clip. The guide rail is retained in the mounting by a screw. This also serves to improve the attachment of the clip to the perforated strip.

6 Claims, 2 Drawing Sheets

FIXTURE FOR THE ATTACHMENT OF A GUIDE RAIL TO THE BODY OF A PIECE OF FURNITURE

BACKGROUND OF THE INVENTION

The invention concerns a fixture for the attachment of a guide rail on the inner side of the side wall of a body or the like using attachment elements arranged apart at right angles to the guide rail.

Usually, guide rails are attached to the side wall of a piece of furniture by attachment screws or rivets. This, however, has the disadvantage in that one could not fit a frame facing on the front of the piece of furniture as the drawers could not then be pulled out of the body. If a frame is required to be mounted on the front the guide rails must then be attached to the side wall of the body at a specific distance from it.

Up to now distance pieces such as wood blocks or tubular plastic pieces have been used which were fixed to the sidewall of the body by correspondingly long screws. This attachment requires however, a considerable amount of assembly time. It can only carry a slight drawer loading on the side wall.

The invention avoids these disadvantages. It is based on the technical problem of the provision of an attachment for guide rails on the side wall of a body or the like in which the guide rails can be attached to the side wall at a distance from it, and for which the connection is easy to assemble, secure and has high load-carrying capability.

BRIEF SUMMARY OF THE INVENTION

To solve this technical problem the invention is characterized in that the attachment elements are formed as attachment clips whose legs engage with their free ends in spaced recesses on the inner face of the side wall and on the approximate centre of which the guide rail is detachably mounted.

The recesses are formed from separately assembled perforated strips or by holes formed directly in the sidewall, which are formed therein either by drilling or milling or other known, similar methods.

The spring legs of the clips are then hooked into these recesses. Because of the loading of the particular drawer in use, the attachment clips are thus made even more rigid so that particularly high loads can be carried by means of this attachment fixture. A required distance between the side wall and the guide rail is ensured by the correspondingly long form of the legs of the attachment clip.

The attachment of the guide rails to the attachment clips is advantageously achieved in that the guide rails are inserted into an approximately U-shaped mounting on the attachment clip.

With reference to this, it is preferred that, on the base of the mounting, spaced holes are provided in which screws attached to the guide rails can be inserted. By insertion of the screws in the holes, in this respect threaded holes, the profile of the base of the U-shaped mounting is correspondingly deformed so that the guide rails are held between the legs of the U. At the same time the other free legs of the attachment clip are correspondingly tilted thus further anchoring it in the row of holes. The base of the U-profile has, therefore, such a section that the middle of the base points to the corresponding sidewall.

The attachment of the attachment clips in the row of holes is further improved when the free ends of the attachment clips are bent up approximately parallel to the sidewall of the body, as is preferred.

For the same reason the free ends of the attachment clips have profiled shoulders whose rear face abuts the perforated strip or the row of holes directly in the sidewalls.

The invention will be further explained in the following by means of an embodiment example from which arise further important features.

DETAILED DESCRIPTION

Figure 1:
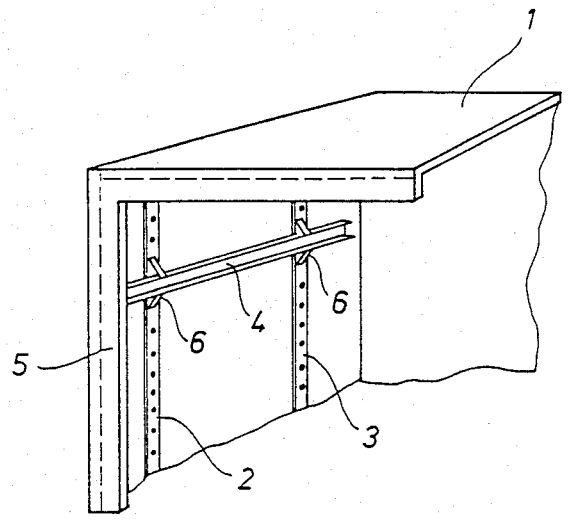
FIG. 1 is a schematic perspective view of the upper left part of a piece of furniture with an attachment fitting for a guide rail in accordance with the invention.

FIG. 1 shows a schematic section of the left side of a body (1) to which two perforated strips (2) (3) are attached, spaced evenly and parallel. The attachment of these perforated strips to the body (1), respectively its side wall, is achieved in accordance with FIG. 2, for example by spaced attachment screws (13).

In order to attache a guide rail (4) at a distance from the side wall of the body (1) onto the perforated strips (2) (3) attachment clips (6) (26) in accordance with the invention are provided. Each of the attachment clips consists of an approximately U-shaped part which has two spring legs (9) (10) bent at an angle from each other whose free ends have upwards-facing tabs (11) (12) which engage in corresponding recesses (7) (8) in the perforated strips (2) (3) and thus are detachably connected to the perforated strips (2) (3).

The spring legs (9) (10) merge, in the direction of the guide rail (4), into bent folds (14) (15) which give the complete attachment clip (6) its spring quality. The folds (14) (15) open out to a base (17) which forms a peak in the middle and which has regularly spaced holes (19) to accept a corresponding attachment screw (18).

In this way the attachment clip (6) forms a mounting slot (16) for the insertion of the guide rail (4) on whose interior a roller arrangement (20) is only shown as an example.

Figure 4:
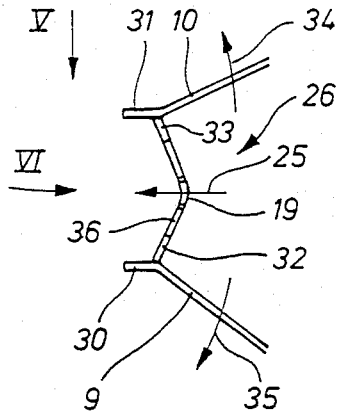
FIG. 4 is a view corresponding with that of FIG. 2 showing a modified embodiment example of an attachment clip in a simplified schematic manner.

The screws (18) fixed to the guide rail (4) are to attach the guide rail (4) to the base (17) of the mounting of the attachment clip (6) which, when screwed in pull the base (17) in the direction of arrow (25) (Ref. FIG. 4) towards the base of the guide rail (4) by which both spring legs (9) (10) are pressed apart in arrow directions (34) (35) (Ref. FIG. 4). In this way an excellent engagement in the perforated strips (2) (3) is created which is only released when the screw (18) is screwed out of the threaded hole (19) again.

The screw (18) is in this case a simple self-tapping screw which engages in the corresponding hole (19) of the base (17) of the attachment clip (6). It is fitted from the inside.

Because the screw (18) moves in the direction of arrow (25) (Ref. FIG. 4) during assembly, the folds (14) (15) are moved together in the direction of arrows (21) (22) so that they grip the guide rail (4) between them. In this way an excellent seating of the guide rail (4) is ensured in the area of the mounting slot (16) of the attachment clip (6).

Figure 2:
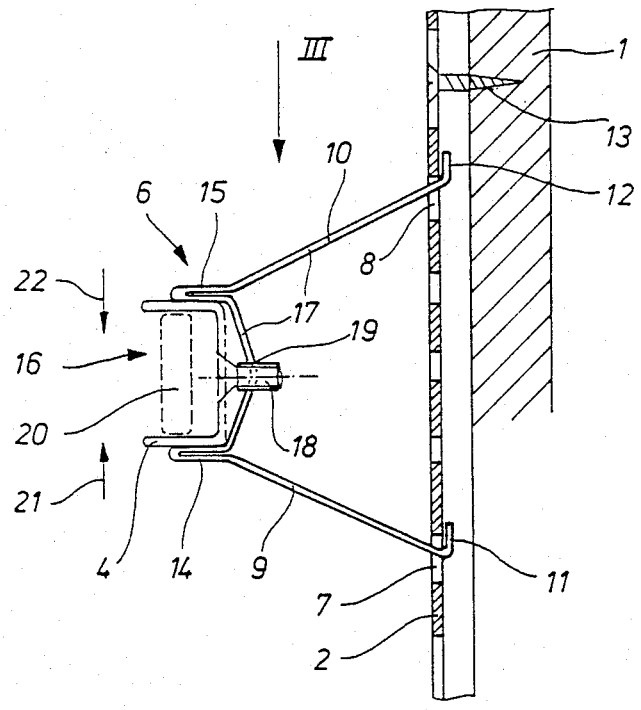
FIG. 2 is a larger scale view of one of the attachment clip with a guide rail attached to it in which the attachment clip engages in a perforated strip which is itself attached to the sidewall of the body in FIG. 1.
Figure 3:
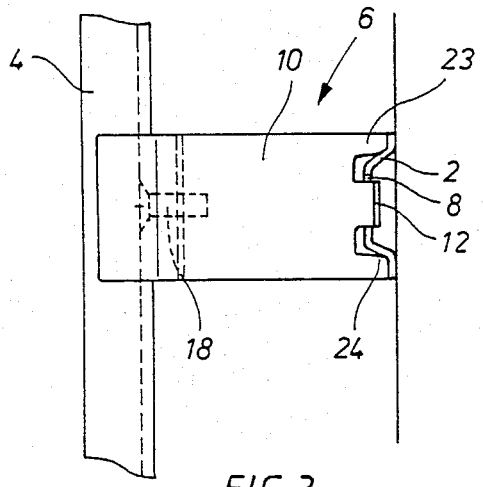
FIG. 3 is a view in the direction of arrow III in FIG. 2.

FIG. 3 shows a plan view of the attachment clip (6) in accordance with FIG. 2 and this shows that on the sides of the tabs (11) (12), shoulders (23) (24) are formed, which abut on the outside of the perforated strip which creates an excellent support for the attachment clip (6) on the perforated strip (2) (3).

Figure 5:
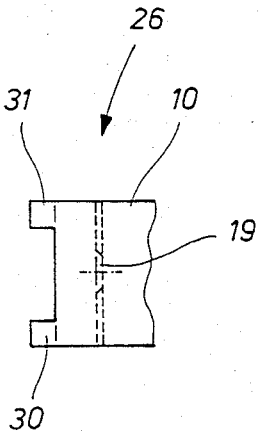
FIG. 5 is a view in the direction of arrow V in FIG. 4.
Figure 6:
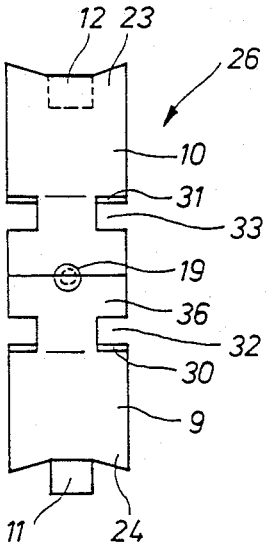
FIG. 6 is a view in the direction of arrow VI in FIG. 4.

In FIGS. 4 to 6 a further embodiment example of an attachment clip (26) is shown. The same parts have the same index numbers.

The difference between this and the embodiment example in FIGS. 2 and 3 is that instead of the folds (14) (15), lugs (30) (31) are pressed out of the material of the attachment clip (26) which perform the gripping action necessary to retain the guide rail (4).

In accordance with FIG. 6, the lugs (30) (31) in the area of the base (36) of the attachment clip (26) are pressed out of corresponding stamped-out recessed (32) (33). Again a converging action of the lugs (31) (32) is created when the attachment screw (18) deforms the base (36) in the direction of arrow (25).

The material of the attachment clip (6) (26) is hardened spring steel.

In analogous fashion guide rails can be attached to other pieces of furniture, for example on the outside of vertical walls of drawers.

I claim:

1. A fixture for the attachment of guide rail of a body having an inner side with a plurality of perforations, said fixture comprising spring-legs each having a free end, each of said free ends having body inner side engaging tabs, and a base connected to said spring legs substantially parallel to and yieldably spaced from the guide rail; and means releasably securing the guide rail to said fixture whereby the spring legs urge the inner side engaging tabs into a locking relationship with the body inner side as the securing means increasingly secures the fixture to the guide rail.

2. The fixture as claimed in claim 1 wherein said inner side engaging tabs have substantially U-shaped configuration.

3. The fixture as claimed in claim 1 wherein said inner side tabs have an element substantially parallel to said body inner side.

4. The fixture as claimed in claim 1 wherein said securing means is one or more screws.

5. The fixture as claimed in claim 1 wherein said spring legs and said base are integral.

6. The fixture as claimed in claim 1 wherein said spring legs form bent folds to engage the guide rail.

* * * * *